United States Patent [19]

Tucker

[11] Patent Number: 4,597,224

[45] Date of Patent: Jul. 1, 1986

[54] AUTOMATIC GARAGE DOOR OPENER

[76] Inventor: Derry E. Tucker, 69 Davidson St., Chula Vista, Calif. 92010

[21] Appl. No.: 576,211

[22] Filed: Feb. 2, 1984

[51] Int. Cl.[4] ..... E05F 11/00

[52] U.S. Cl. ..... 49/199; 49/280

[58] Field of Search ..... 49/197, 199, 200, 291, 49/293, 279, 280; 160/188, 192, 193

[56] References Cited

U.S. PATENT DOCUMENTS 2,589,479 3/1952 Curtis ..... 160/188 X 2,589,480 3/1952 Curtis ..... 49/280 X 3,704,548 12/1972 Wiegleb ..... 49/199

3,708,917 1/1973 Streeter ..... 49/280

*Primary Examiner*—Kenneth Downey

*Attorney, Agent, or Firm*—Charmasson & Holz

[57] ABSTRACT

An improved automatic garage door opener system is described, the delay linkage in the motorized door opening mechanism which enables actuation of latch closures for improved security and also provides improved shock cushioning in the system.

5 Claims, 9 Drawing Figures

FIG. 1
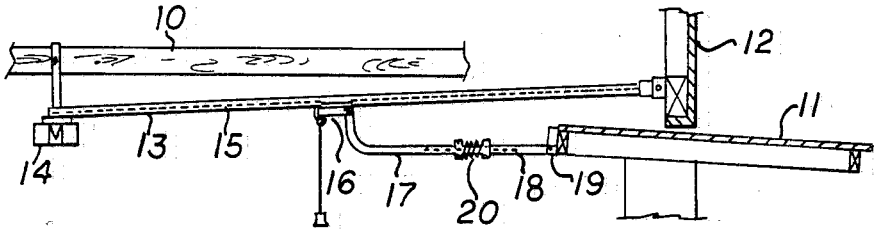
FIG. 4
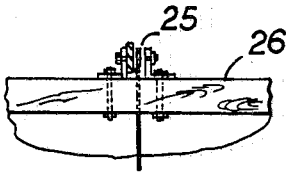
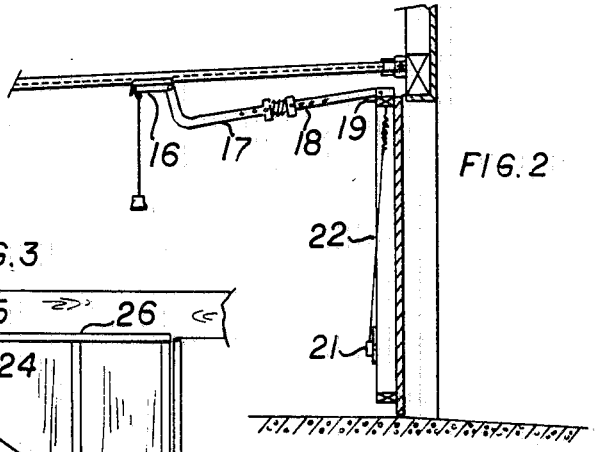
FIG. 2
FIG. 3
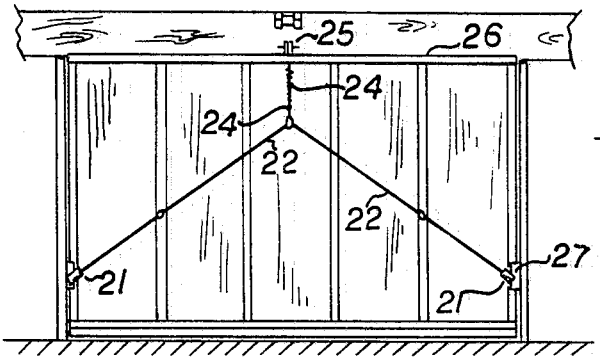
FIG. 5
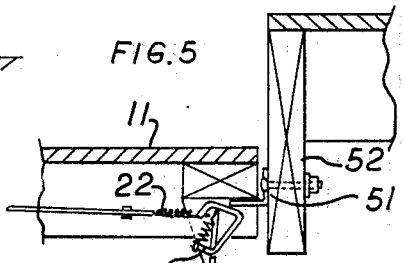
FIG. 6
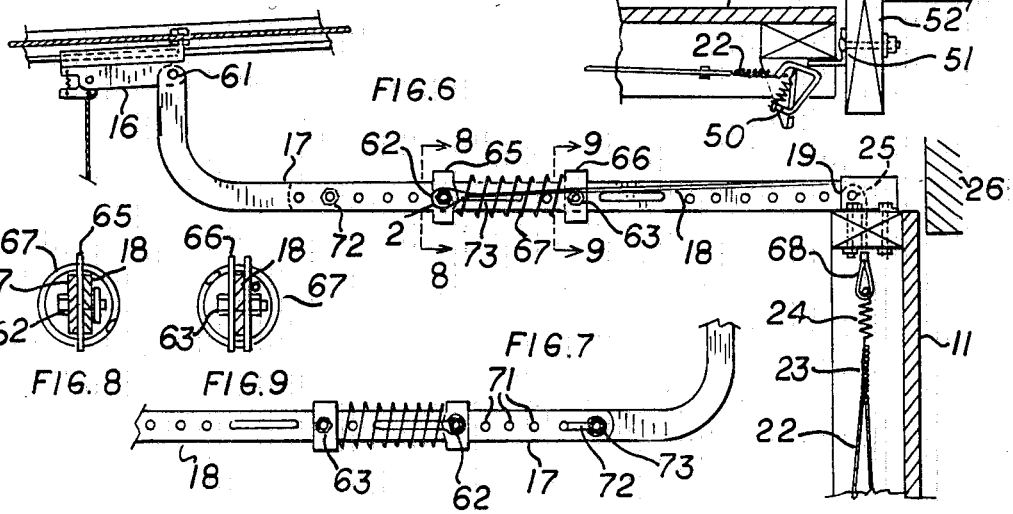
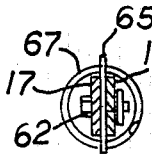
FIG. 8
FIG. 9
FIG. 7

AUTOMATIC GARAGE DOOR OPENER

BACKGROUND OF THE INVENTION

Automatic door openers in common use for applications such as garage doors are subject to several problems which this invention addresses. The principal difficulty in sliding door applications of remotely-actuated power door openers is that the door closure is not completely secure because of system slack and lack of an integral positive lock. This problem is accentuated with modern one-piece, swing arm, spring-biased garage doors which, because they are made in one piece, are not completely rigid, and a determined intruder can gain access by bending up a garage door by its corner even though the closing mechanism remains in the down position. Thus, a more positive perimeter latch system is needed to prevent flexing the door. Although other devices in the art have provided such latching mechanisms, such as Reamey, Door Operating Device, U.S. Pat. No. 2,703,235, sectional door systems such as Reamey cannot be conveniently or effectively integrated with modern one-piece garage door systems.

The within invention provides a delay latching mechanism that can be more effectively and conveniently applied to modern one-piece garage door systems by improving the rigidity of the closure linkage while at the same time maintaining a shock-cushioning mechanism and sufficient delay to enable latch actuation before commencement of door travel. Another problem encountered in installation of modern garage door openers is that for safety reasons modern openers typically include an obstruction sensor and reverse trip switch which may be critically sensitive and affected by addition of other subsystems and functions that could trigger the trip switch. Therefore, the desirable rigidity of the system must be tempered or damped to avoid shocks or to insulate the trip switch from shocks within normal operation while maintaining sufficient tension on the system linkage to continue operation. Finally, since many thousands of door opener installations already exist to which these improvements can or should be applied, the provisions for meeting the above objectives of security and shock insulation should be amenable to retroactive installation, minimizing inconvenience and expense.

These objectives are addressed by the within invention by provision for a linkage of at least two parts movable relative to each other over a short range and spring biased to provide both sufficient tension and shock absorption to the system in operation. The linkage is designed and calculated to easily replace existing rigid linkages and typical door opener installations.

The typical modern one-piece overhead garage door is assembled and adjusted on site by construction contractors who are primarily concerned with keeping costs down. The door is usually made of fiber board or plywood braced by timbers; it is mounted on swing arm carriage, in balance or counter-weighted by adjusting heavy springs to the individual requirements of each door. The varying weights and distances in each door make individual adjustment necessary; a small change in the distance between components can change the lever arm disproportionately and make the door much easier or harder to move. These doors are prone to unpredictable warpage and other changes with age and weather, because they are generally hastily built from various types of low grade wood. Doors that work perfectly one day may swell shut the next. For these reasons, any system added to this sort of door must function effectively over a wide variety of conditions, and a wide range of specifications, and yet have some self-adjusting features.

SUMMARY OF THE INVENTION

The within invention constitutes a mechanical trigger and delay system to be used with automatic door openers on the common one-piece swing arm spring biased overhead door. It will automatically unlock the door before it is opened and automatically lock it after it is closed. It is a simple device that replaces the solid arm that connects the door to the power transmitting chain in most automatic door openers, it could be provided with the original equipment, as an inexpensive inprovement to current models, or it could be equally easily adapted to most automatic door openers that are already installed.

The trigger in the delay system is embodied in two rigid arms movably mounted in parallel relationship, movable over a short range of motion and spring-biased within that range. A cable is connected to the rear arm and threaded over a pulley; it is fastened to a spring and chain in series which in turn hold a second cable connected to the latches themselves.

When the pressure of the door opener motor overcomes the spring biased between the two arms the rear arm move within the range of relative motion between the two arms a short distance and enough to pull a cable connected to the door latches to release the latches. The door latches are spring loaded and rest in the locked position until the cable movement releases them. At the end of travel the rear arm engages the stop position in the forward arm which is rigidly connected by a swivel joint to the door itself and the motor will then raise the entire door and latching mechanism in conventional manner.

A wide range of spring bias and force and travel between the two arms is tolerable, as long as there is enough travel to pull the latches clear, at least an inch but not so much that the spring loses contact with its collar. The spring needs to provide some cushioning which could probably range from biasing force a pound to several pounds.

The object of this invention is primarily to provide readily adaptable modification for automatic garage door openers that would allow owners to regain security in the form of a positive perimeter latching system without sacrificing convenience. It is intended to be simple, require a minimum adjustment, adjust itself to a wide range of conditions, without side effects such as false sensings of obstructions by the motor reversing switch. In fact the system provides improved shock absorption in the typically rigid linkage that will eliminate many such obstruction false alarms commonly triggered by normal perturbations in the travel of the door, yet will still provide a good margin of safety since a significant obstruction would overcome the short range of movement of the spring biased delay arm system and render a positive jolt to the arm that would overcome the reversing switch threshold.

BRIEF DESCRIPTION OF THE DRAWINGS

FIG. 1 is a side view of the garage opener device showing the door in open position in a typical installation;

FIG. 2 is a side view of the device showing the garage door in closed position;

FIG. 3 is a rear view of the closed door showing the latch and cable actions;

FIG. 4 is a rear view showing the releasing cable which is connected to the rear arm here theaded over a pulley through a hole in the door frame;

FIG. 5 is a overhead or top view of the door latches;

FIG. 6 is a side view of the device specifically delineating the parallel arms of the trigger and delay device;

FIG. 7 is a fractional side view of the arms constituting the trigger and delay device from the opposite side as FIG. 6;

FIG. 8 is a section taken along 8—8 of FIG. 6 illustrating the relationship of the parallel arms and spring mechanism;

FIG. 9 is a section along 9—9 of FIG. 6 illustrating the arms and spring mechanism.

DETAILED DESCRIPTION OF THE PREFERRED EMBODIMENT OF THE INVENTION

FIG. 1 of the drawings illustrates the improved garage door opener device mounted on the garage overhead beam 10 and showing the garage door 11 in the open position in relation to the garage door frame 12. The standard garage door opening mechanism consisting of a track 13 mounted near the garage ceiling but clear of the door travel and a motor 14 with a chain drive 15 and a carriage 16 which travels on the track when the motor is activated and raises the garage door through a linkage series. The linkage series is the point of the improvement described herein, and consists of a rear arm 17 rigidly attached to the carriage 16, a forward arm 18 which is linked with the top of the garage door itself by a swivel connection 19, the forward and rear arms movable parallel to each other through the range of a spring biasing connector 20. The relationship with the components is further illustrated in FIG. 2 showing the door in closed position, with carriage 16 having been moved forward along the track and forcing the linkage arms to move the door downward through its range of motion defined by the swing arms mounted on the door frame a pair of latches 21 are provided at the perimeter of the door frame connected by cable 22 in order to positively lock the door in the down position.

FIG. 3 illustrates the latch and cable linkage that operates when the door is in the down position. The spring actuated latches 21 in the closed position will engage a stop and keeper 27 mounted on the side door frame in conventional manner. The cable 22, typically aircraft grade steel cable, is mounted in yoke fashion to simultaneously disengage the spring latches when the connecting chain 23 is tensioned upward. A spring 24 is interposed at the tensioning chain shortly above the yoke connection to smooth and damp the beginning travel of the cable when tensioned. A pulley mechanism 25 mounted on the top timber 26 of the moveable door provides a guidepath for the travel of the cable.

FIG. 4 illustrates in further detail the pulley 25 mounted on timber 26, and the pathway of the cable through a hole drilled in timber 26, and the cable passing through the hole showing in hidden view.

FIG. 5 is a more detailed view of the latch mechanism from a top view on the right side of the door, consisting of a rocker latch 50 a stop 51 bolted to the side of the door frame 52 connected to pulley chain 22 such that when the pulley chain 22 is tensioned the rocker latch will move to the left releasing itself from the frame mounted stop. In the reverse operation, when the door is coming down the rocker latch will be moved to the left as it comes in contact with the stop and when it arrives at the bottom position below the stop will move again to the right lockably engaging the stop and preventing upward movement until the rocker latches disengage by again tensioning the cable.

FIG. 6 illustrates the components of the carriage and parallel arms which provide the unlatching tension on the cable and in sequence the transmitted upward force to raise the door. Carriage 16 is shown attached to rear arm 17 (by swivel bolt connection 61) which slides in relation to forward arm 18. The length of travel between the two is limited by the movement of their connecting bolts 62 and 72 within slots 64 and 73. The bolts 62 and 63 also serve to hold spring collars 65 and 66. The spring itself 67 coiled around the overlapping portions of arms 17 and 18 and confined by spring collars 65 and 66 serves to simulaneously cushion impacts and to keep positive pressure in the range of movement. A cable 68 is connected to the tensioning chain 23 by a spring 24 and is secured to the rear arm 17 at bolt 62 providing means for the rearward movement of arm 17 to tension cable 68 and thereby draw the spring latches to which it is ultimately connected to the open position.

When the door operation is commenced by activating the motor, the motor draws carriage 16 rearward along the track, in turn drawing rear arm 17 with it. Arm 17 tensions the cable 68 which through the aforedescribed linkage draws the spring latches open. The rear arm will continue to move rearward pulling against the tension of latch spring 67 and drawing cable 68 upward until bolts 62 and 72 attached to the foreward end of the rear arm 17 reaches the end of its travel within slots 64 and 73 at the rearward end of the slots and thereby engages foreward arm 18. Because foreward arm 18 is rigidly attached to the door frame at swivel connection 19, the door operation then commences and the latch cable will travel no further since it is connected to the entire door being raised. The door motion will then continue upward until the upper limit is reached and the motor shut-off switch is activated.

In the reverse operation the motor will move carriage 16 forward on the track in turn pushing rear arm 17 and forward arm 18 in the forward direction, thus moving the door downward. When the door is closed and reaches the stops 51, the forward arm 18 also stops permitting parallel movement of rear arm 17 releasing tension on cable 68 allowing latch 50 to extend over stop 51 and the normal operation of the motor limit switch will stop movement of the carriage 16.

FIG. 7 illustrates that the spring 61 tension may be relatively adjustable to vary the length of the relative movement of the two arms 17 and 18 by providing a series of spaced holes 71 on the arms for connection of the spring collar bolt 62. Other methods of providing relative motion between 17 and 18 could easily be provided such as a parallelagram offset linkage between the two arms being connected by short separating arms and the parallelagram thus formed being spring biased across a diagonal. Other arrangements of biasing the movement between components could be constructed and still be within the spirit of the invention.

FIG. 8 in cross section further illustrates the close relationship between the slideably mounted arms 17 and 18, the rear spring keeper 65 and front slot bolt 62.

FIG. 9 illustrates the relationship in cross section of the forward spring keeper 66 mounted on the forward arm 18 by bolt 63.

What is claimed is:

1. In an automatic door opener system including a track for movement of a motorized carriage, an improved connection between the carriage and door including a mechanical latching and delay device comprising:

a. a first rigid element linked to the carriage;

b. a second rigid element linked to the door;

c. connecting means between the two linkage elements allowing for a short range of movement relative to each other;

d. biasing means between the first and second rigid elements;

e. latching means mounted on the door and biased to the closed position; and f. latch acutating means connected to said first rigid element such that travel of said first element will actuate the latch before overcoming the bias and applying tension to said second linkage element to raise the door.

2. The device of claim 1 wherein the connecting means between the two linkage elements is provided by slots in said second linkage element, the forward end of said first rigid element and the rear-end of said second rigid element being connected through said slots by connecting bolts, which limit the travel of said linkage arms relative to each other.

3. The device of claim 1 wherein the biasing means is provided by a spring retained between the first and second rigid elements by a spring collar mounted on the forward end of the first rigid element and the center of the second rigid element.

4. The device of claim 1 wherein the latch actuating means is a cable connected from the first rigid element to the latches mounted on the door.

5. The device of claim 1 wherein the connecting means between the two linkage elements consists of two additional parallel linking elements, connected to the first and second rigid elements such that a parallelagram is formed and a biasing means arranged to resist the compression of first and second rigid elements.

* * * * *